US010222816B1

(12) United States Patent
Avitan

(10) Patent No.: US 10,222,816 B1
(45) Date of Patent: Mar. 5, 2019

(54) COMPENSATED SOURCE-FOLLOWER BASED CURRENT SOURCE

(71) Applicant: Marvell Israel (M.I.S.L) Ltd., Yokneam (IL)

(72) Inventor: Shimon Avitan, Tal-El (IL)

(73) Assignee: MARVELL ISRAEL (M.I.S.L) LTD., Yokneam (IL)

( * ) Notice: Subject to any disclaimer, the term of this patent is extended or adjusted under 35 U.S.C. 154(b) by 0 days.

(21) Appl. No.: 15/694,799

(22) Filed: Sep. 3, 2017

Related U.S. Application Data

(60) Provisional application No. 62/385,570, filed on Sep. 9, 2016.

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS 5,631,600 A * 5/1997 Akioka ..... G05F 3/267 327/513
6,091,286 A * 7/2000 Blauschild ..... G05F 3/245 327/538
6,111,397 A * 8/2000 Leung ..... G05F 3/245 323/312
6,831,504 B1 * 12/2004 Holloway ..... G05F 3/245 323/315
6,903,601 B1 * 6/2005 Aude ..... G05F 3/262 323/313
9,740,229 B2 * 8/2017 Afzal ..... G05F 3/02
9,921,600 B1 * 3/2018 Far ..... G05F 3/262
9,948,288 B2 * 4/2018 Yoshimoto ..... H03K 17/14
2003/0107429 A1 * 6/2003 Kawano ..... G05F 1/575 327/538
2003/0201791 A1 * 10/2003 Andrys ..... G05F 3/205 326/33
2004/0104765 A1 * 6/2004 Ebner ..... G05F 3/242 327/543
2007/0052404 A1 * 3/2007 Richardson ..... G05F 3/30 323/316
2011/0003574 A1 * 1/2011 Chang ..... G05F 3/242 455/323
2012/0092064 A1 * 4/2012 Floyd ..... G05F 3/242 327/543

(Continued)

*Primary Examiner* — Yusef A Ahmed

(57) ABSTRACT

An electronic circuit for current generation includes a source-follower based current source and a voltage compensation semiconductor device. The source-follower based current source is configured to output a reference current, the current source including a main transistor which is configured to derive the reference current from a reference voltage, wherein the main transistor has a voltage drop that varies with temperature and process variations. The voltage compensation semiconductor device is configured to be biased with bias currents that increase the reference voltage provided to the main transistor by an offset voltage that matches the voltage drop of the main transistor across at least part of the temperature and process variations, thereby pre-compensating for the voltage drop of the main transistor.

10 Claims, 3 Drawing Sheets

(56) References Cited

U.S. PATENT DOCUMENTS

| | | | | |
|---|---|---|---|---|
| 2013/0162358 | A1* | 6/2013 | Xiao | G05F 3/242 331/66 |
| 2015/0171130 | A1* | 6/2015 | Lee | H04N 5/37455 250/208.1 |
| 2016/0072485 | A1* | 3/2016 | Vice | H03F 1/0255 |

* cited by examiner

COMPENSATED SOURCE-FOLLOWER BASED CURRENT SOURCE

CROSS-REFERENCE TO RELATED APPLICATIONS

This application claims the benefit of U.S. Provisional Patent Application 62/385,570, filed Sep. 9, 2016, whose disclosure is incorporated herein by reference.

FIELD OF THE DISCLOSURE

The present disclosure relates generally to electrical current sources, and particularly to source-follower based current sources.

BACKGROUND

Current sources are used for various purposes in a wide variety of electronic devices, e.g., for generating accurate reference currents. One common technique for generating a highly accurate current is by using a bandgap voltage reference.

The description above is presented as a general overview of related art in this field and should not be construed as an admission that any of the information it contains constitutes prior art against the present patent application.

SUMMARY

An embodiment that is described herein provides an electronic circuit for current generation, including a source-follower based current source and a voltage compensation semiconductor device. The source-follower based current source is configured to output a reference current, the current source including a main transistor which is configured to derive the reference current from a reference voltage, wherein the main transistor has a voltage drop that varies with temperature and process variations. The voltage compensation semiconductor device is configured to be biased with bias currents that increase the reference voltage provided to the main transistor by an offset voltage that matches the voltage drop of the main transistor across at least part of the temperature and process variations, thereby pre-compensating for the voltage drop of the main transistor.

In some embodiments, the voltage compensation semiconductor device is connected between the reference voltage and a gate of the main transistor. In an embodiment, the voltage compensation semiconductor device includes an auxiliary transistor that is biased to match the main transistor in current density. In an example embodiment, the voltage compensation semiconductor device is biased to have a threshold voltage that matches the voltage drop of the main transistor across the at least part of the temperature and process variations.

In a disclosed embodiment, the source-follower based current source includes a main current mirror configured to generate the reference current, and the electronic circuit further includes one or more auxiliary current mirrors configured to generate the bias currents that bias the voltage compensation semiconductor device, by mirroring the main current mirror. In an embodiment, the bias currents are set to null an error current flowing via the compensation semiconductor device. In some embodiments, the electronic circuit further includes a voltage divider configured to derive the reference voltage from a supply voltage.

There is additionally provided, in accordance with an embodiment that is described herein, a method for current generation, including deriving a reference current from a reference voltage using a source-follower based current source, which includes a main transistor having a voltage drop that varies with temperature and process variations. A voltage compensation semiconductor device is biased with bias currents that increase the reference voltage provided to the main transistor by an offset voltage that matches the voltage drop of the main transistor across at least part of the temperature and process variations, thereby pre-compensating for the voltage drop of the main transistor.

The present disclosure will be more fully understood from the following detailed description of the embodiments thereof, taken together with the drawings in which:

DETAILED DESCRIPTION OF EMBODIMENTS

Figure 1:
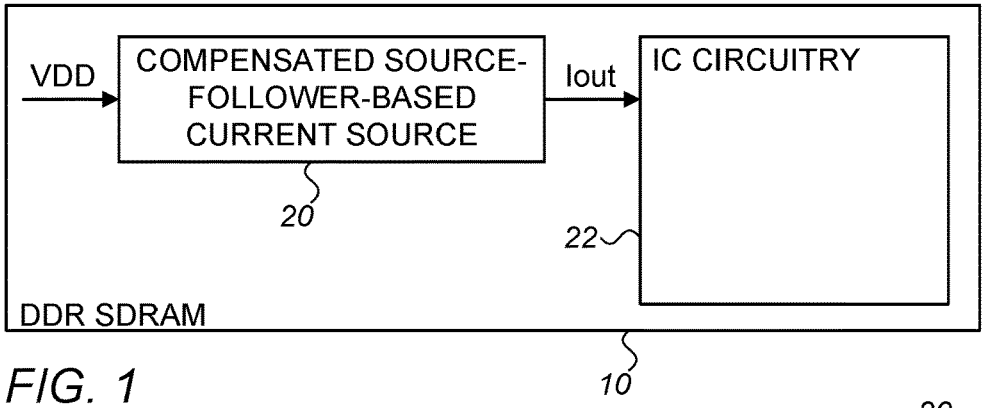
FIG. 1 is a block diagram that schematically illustrates a memory device comprising a compensated source-follower based current source circuit, in accordance with an embodiment that is described herein.

Embodiments that are described herein provide improved source-follower based current source circuits and associated methods. The disclosed current source designs can be used, for example, for generating a reference current that remains highly stable and accurate over temperature and process variations.

In some embodiments, a current source circuit comprises a main transistor that is connected in a source-follower configuration. In this configuration, the gate of the main transistor serves as an input that receives a reference voltage, the source of the main transistor serves as an output, and the drain of the main transistor is common to the input and the output. The main transistor is configured to receive the reference voltage, e.g., from a voltage divider connected to supply voltage, and to derive the reference current from the reference voltage.

In practice, however, the main transistor typically has an internal voltage drop that varies with temperature and process variations. This variable voltage drop causes the reference current generated by the current source to vary, as well.

In some disclosed embodiments, the above variations are compensated for by a voltage compensation semiconductor device (e.g., a diode, or a transistor connected as a diode) that is connected between the voltage divider and the main transistor. The voltage compensation semiconductor device increases the reference voltage provided to the main transistor by an offset voltage. The design and biasing of the voltage compensation semiconductor ensures that the offset voltage matches (i.e., varies similarly to) the voltage drop of the main transistor across a relevant range of temperature and process variations.

When applying the voltage compensation semiconductor in this manner, the variable offset voltage pre-compensates for the variable voltage drop of the main transistor. Stated another way, in some embodiments the input (gate) of the main transistor is provided with an increased reference voltage that, when reduced by the internal voltage drop of the main transistor, yields a stable and accurate reference voltage at the output (source) of the main transistor, over a suitable range of temperatures and process variations.

In a typical embodiment, the voltage compensation semiconductor device comprises an auxiliary transistor that is of the same type as the main transistor, and also matches the main transistor in current density. The auxiliary transistor is biased such that the current flowing through it is negligible. When these conditions are met, the offset voltage added by the auxiliary transistor compensates accurately for the voltage drop of the main transistor. An example configuration of auxiliary current mirrors that perform such biasing is described herein.

The disclosed techniques enable generation of accurate reference currents over a wide range of operating conditions. At the same time, the disclosed circuits are low-cost and obviate the necessity, in some circuits, to use relatively expensive devices, such as bandgap voltage references.

FIG. 1 is a block diagram that schematically illustrates a memory device 10 comprising a compensated source-follower based current source circuit 20, in accordance with an embodiment that is described herein. In the present example, memory device 10 comprises a Double Data Rate Synchronous Dynamic Random-Access Memory (DDR SDRAM) device. In alternative embodiments, however, the disclosed circuits and associated methods are applicable in a wide variety of electronic devices, e.g., other types of memory devices, and network devices such as packet switches, or in any other suitable electronic device.

In the example embodiment of FIG. 1, current source 20 receives as input a supply voltage denoted VDD. From this supply voltage, current source 20 derives an output current denoted Iout, which is highly accurate and stable across a range of operating temperatures and process variations. Output current Iout is provided as a reference current to IC circuitry 22. Example circuit configurations for implementing current source 20 are described below and depicted in FIGS. 2 and 3.

Figure 2:
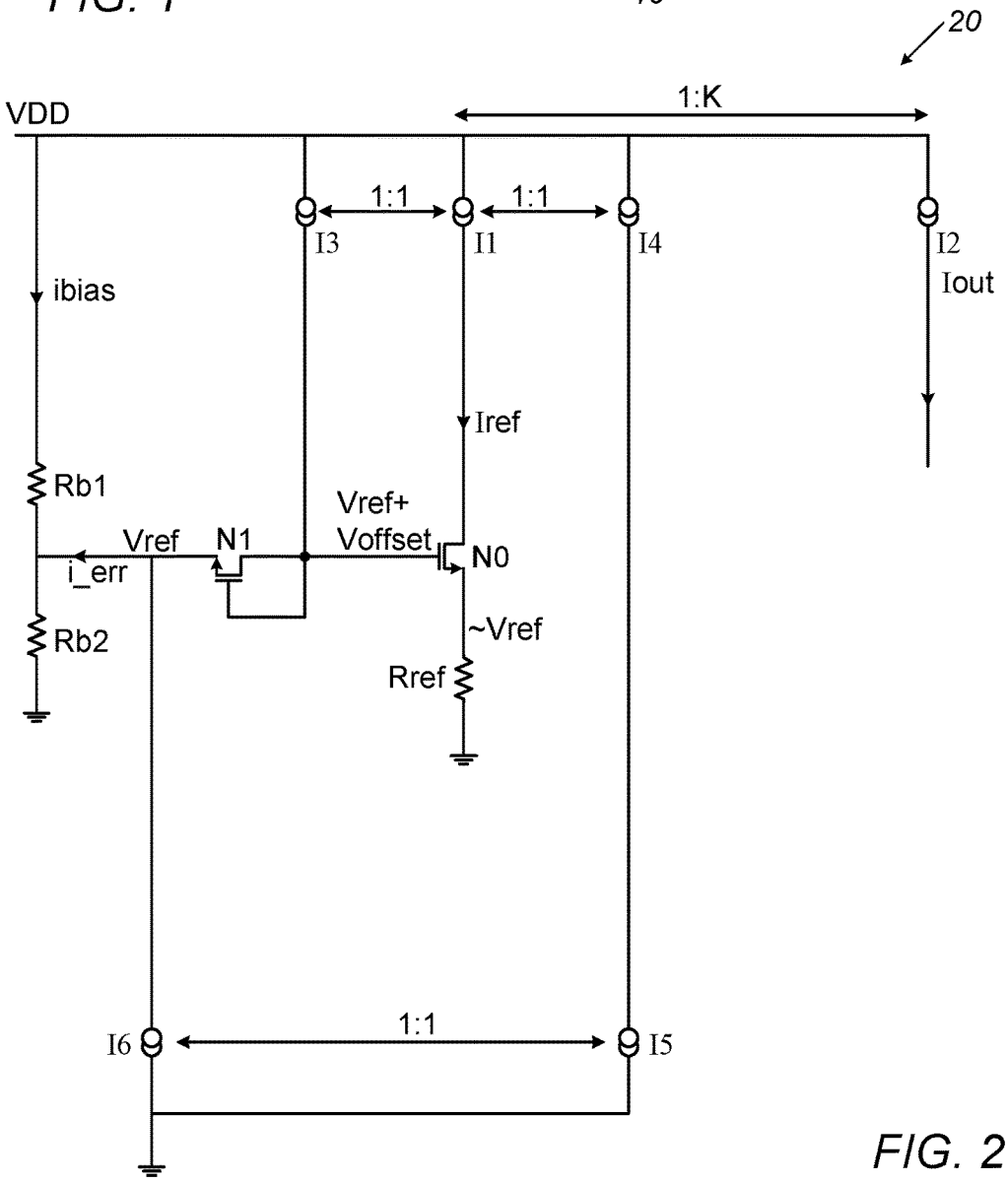
FIGS. 2 and 3 are circuit diagrams that schematically illustrate compensated source-follower based current source circuits, in accordance with embodiments that are described herein.

FIG. 2 is a circuit diagram that schematically illustrates compensated source-follower based current source circuit 20, in accordance with an embodiment that is described herein. In the present embodiment, circuit 20 comprises two resistors denoted Rb1 and Rb2, which together form a voltage divider between a supply voltage VDD and ground. A reference voltage denoted Vref is taken from the middle junction of the voltage divider.

In an embodiment, circuit 20 further comprises a main transistor denoted N0. Main transistor N0 is connected in a source-follower configuration. In this configuration, a resistor denoted Rref is connected between the source of N0 and ground, and a current mirror denoted I1 is connected between the drain of N0 and VDD. The drain current of main transistor N0 is referred to as a reference current and denoted Iref. A current mirror denoted I2 mirrors I1 (i.e., mirrors the reference current Iref) by a factor 1:K, so as to produce the output current denoted Iout. Output current Iout is provided as the output of circuit 20. As will be explained in detail below, Iout is retained substantially constant over temperature and process (unit-to-unit) variations.

In practice, main transistor N0 has an internal voltage drop between its gate and source. The voltage drop typically varies with temperature and process variations. Unless accounted for, the variations in the voltage drop of main transistor N0 cause the reference current Iref to vary with temperature and process variations, as well. These variations are reflected directly to the output current Iout.

In an embodiment, circuit 20 further comprises an auxiliary transistor denoted N1. N1 is connected between the voltage divider, which produces Vref, and the gate of main transistor N0. In the present example, N1 has its gate and drain shorted to one another, and thus operates as a diode. Auxiliary transistor N1 compensates for the voltage drop of main transistor N0 by increasing reference voltage Vref by a voltage offset denoted Voffset. The increased reference voltage (Vref+Voffset) is provided to the gate of main transistor N0.

In some embodiments, when the three conditions listed below are met, the offset voltage Voffset matches the voltage drop of main transistor N0 over at least part of the temperature and process variations. As a result, Iref and Iout remain substantially constant over the relevant range of temperature and process variations:

- Main transistor N0 and auxiliary transistor N1 are of the same type. In the present example, both transistors are N-type Metal-Oxide-Semiconductor (NMOS) Field-Effect Transistors (FETs). Alternative types of transistors are addressed below.
- Auxiliary transistor N1 matches main transistor N0 in current density (measured in current per unit active area of the transistor, e.g., $\mu A/\mu m^2$). This matching is achieved by proper dimensioning and biasing of the two transistors, as explained further below.
- Auxiliary transistor N1 is biased so as to null the current flowing through it (denoted i_err). The term "nulling i_err" means biasing N1 such that e err is negligible relative to the bias current (denoted ibias) flowing through the voltage divider.

In various embodiments, various suitable biasing schemes can be used for minimizing i_err. In the embodiment of FIG. 2, current mirror I1 is referred to as a main current mirror, and biasing of auxiliary transistor N1 is performed by four auxiliary current mirrors denoted I3, I4, I5 and I6. As seen in the figure, I3 mirrors I1 by a factor of 1:1, I4 mirrors I1 by a factor of 1:1, and I6 mirrors I5 by a factor of 1:1. As a result, the current i_err flowing through auxiliary transistor N1 is approximately zero, or at least negligible relative to ibias. Alternatively, any other suitable biasing scheme that achieves negligible i_err can be used.

FIG. 2 demonstrates, in accordance with an embodiment, how a voltage compensation semiconductor device (in the present example auxiliary transistor N1) is configured to be biased with bias currents that increase the reference voltage provided to the main transistor N0 by an offset voltage. The offset voltage matches the voltage drop of the main transistor across at least part of the temperature and process variations, thereby pre-compensating for the voltage drop of the main transistor.

Figure 3:
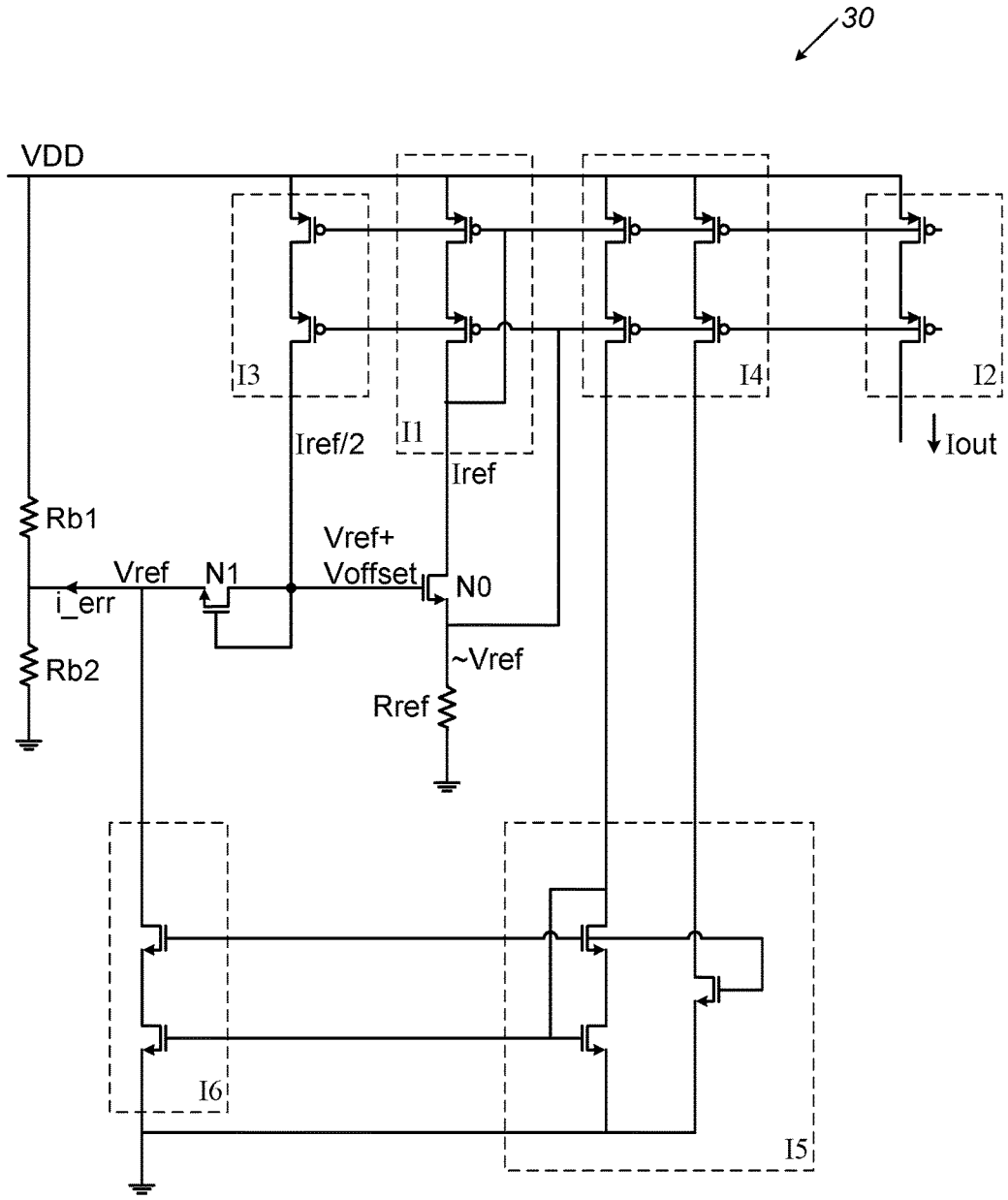

The example biasing scheme above assumes that main transistor N0 and auxiliary transistor N1 have the same active area size. With this design choice, mirroring I1 by a factor of 1:1 to I3 and I6 causes transistors N0 and N1 to match one another in current density. FIG. 3 below shows an alternative biasing scheme that still matches the current density in N0 and N1, but without mandating that the two transistors be of the same size.

FIG. 3 is a circuit diagram that schematically illustrates a compensated source-follower based current source circuit 30, in accordance with another embodiment that is described herein. The general configuration of circuit 30 is similar to that of circuit 20 of FIG. 2.

In the present example, each of current mirrors I1-I6 is implemented using MOS transistors. I1-I4 are implemented using P-type MOS (PMOS) FETs, and I5 and I6 are implemented using NMOS FETs. In alternative embodiments, any other suitable implementation can be used.

In the embodiment of FIG. 3, auxiliary transistor N1 is of the same type as main transistor N0, but the two transistors differ in the size of their active area. In the present example, the size of the active area of auxiliary transistor N1 is half the size of the active area of main transistor N0. In order to match the current density between the two transistors, the biasing scheme sets the current of I3 and the current of I6 to Iref/2 (as opposed to Iref in the example of FIG. 2). In other words, the mirroring ratio between I1 and I3, and between I1 and I6 (via I4 and I5) is set to 2:1 (as opposed to 1:1 in the example of FIG. 2). In alternative embodiments, any other suitable mirroring ratio, and any other suitable ratio between the active areas of N0 and N1, can be used, as long as the current densities are matched between the two transistors.

The configurations of circuits 20 and 30 shown in FIGS. 2 and 3 are example configurations that are depicted solely for the sake of clarity. In alternative embodiments, any other suitable configurations can be used. For example, main transistor N0 and auxiliary transistor N1 may comprise PMOS FETS, or any other suitable transistor type.

As another example, any other suitable semiconductor device, e.g., a diode, may be used as a voltage compensation semiconductor device instead of auxiliary transistor N1. The voltage compensation semiconductor device is typically biased to have a threshold voltage that matches the voltage drop of the main transistor across at least part of the temperature and process variations.

The different elements of the disclosed circuits may be implemented using dedicated hardware, such as using discrete components and/or in an Application-Specific Integrated Circuit (ASIC). Circuit elements that are not mandatory for understanding of the disclosed techniques have been omitted from the figures for the sake of clarity.

Figure 4:
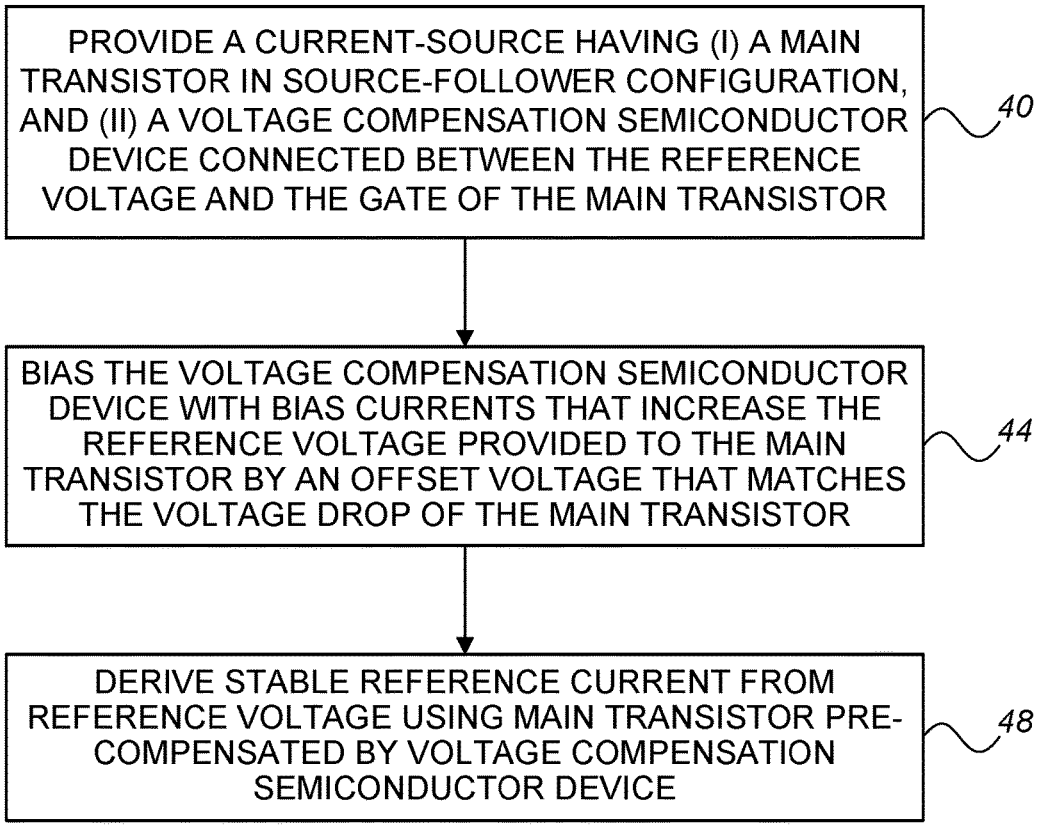
FIG. 4 is a flow chart that schematically illustrates a method for current generation, in accordance with an embodiment that is described herein.

FIG. 4 is a flow chart that schematically illustrates a method for current generation, in accordance with an embodiment that is described herein. The method begins by providing a source-follower-based current source such as circuit 20 shown in FIG. 2 or circuit 30 shown in FIG. 3, at a source-follower provisioning operation 40. As explained above, the source-follower-based current source comprises a main transistor (e.g., transistor N0 of FIGS. 2 and 3) and a voltage compensation semiconductor device (e.g., transistor N1 of FIGS. 2 and 3).

At a biasing operation 44, the voltage compensation semiconductor device is biased with suitable bias currents, e.g., using current mirrors I1-I6 of FIGS. 2 and 3. The bias currents are set to increase the reference voltage provided to the main transistor by an offset voltage, which matches the voltage drop of the main transistor. Using the techniques explained above, this matching is maintained across a desired range of temperatures and process variations. At a reference-current derivation operation 48, the source-follower-based current source circuit derives an accurate and stable reference current from the supply voltage.

It is noted that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. An electronic circuit for current generation, the electronic circuit comprising:
- a source-follower based current source comprising
  - a main transistor configured (i) to receive a reference voltage as input, (ii) to derive a reference current from the reference voltage, and (iii) to provide the reference current as output, wherein the main transistor has a voltage drop that varies with temperature and process variations, and
  - a main current mirror configured to generate the reference current;
- a voltage compensation semiconductor device configured to increase the reference voltage provided as the input to the main transistor by an offset voltage that compensates for the voltage drop of the main transistor over a range of the temperature and process variations; and
- one or more auxiliary current mirrors configured to generate, by mirroring the main current mirror, bias currents that bias the voltage compensation semiconductor device, wherein the bias currents are set to null an error current flowing via the compensation semiconductor device.

2. The electronic circuit according to claim 1, wherein the voltage compensation semiconductor device is connected between the reference voltage and a gate of the main transistor.

3. The electronic circuit according to claim 1, wherein the voltage compensation semiconductor device comprises an auxiliary transistor that is biased to match the main transistor in current density.

4. The electronic circuit according to claim 1, wherein the voltage compensation semiconductor device is biased to have a threshold voltage that compensates for the voltage drop of the main transistor over the range of the temperature and process variations.

5. The electronic circuit according to claim 1, further comprising a voltage divider configured to derive the reference voltage from a supply voltage.

6. A method for current generation, the method comprising:
- using a source-follower based current source, which comprises a main transistor having a voltage drop that varies with temperature and process variations,
  - receiving a reference voltage as input to the main transistor,
  - deriving a reference current from the reference voltage, wherein deriving the reference current comprises generating the reference current using a main current mirror in the source-follower based current source, and
  - providing the reference current as output from the main transistor;
- using a voltage compensation semiconductor device,
  - increasing the reference voltage provided as the input to the main transistor by an offset voltage that compensates for the voltage drop of the main transistor over a range of the temperature and process variations, and using one or more auxiliary current mirrors, generating, by mirroring the main current mirror, bias currents that bias the voltage compensation semiconductor device, wherein the bias currents are set to null an error current flowing via the compensation semiconductor device.

7. The method according to claim 6, wherein the voltage compensation semiconductor device is connected between the reference voltage and a gate of the main transistor.

8. The method according to claim 6, wherein the voltage compensation semiconductor device comprises an auxiliary transistor, and wherein the method further comprises biasing the auxiliary transistor to match the main transistor in current density.

9. The method according to claim 6, further comprising biasing the voltage compensation semiconductor device to have a threshold voltage that matches the voltage drop of the main transistor over the range of the temperature and process variations.

10. The method according to claim 6, further comprising deriving the reference voltage from a supply voltage using a voltage divider.

* * * * *